United States Patent [19]

Wivinis

[11] 4,348,884

[45] Sep. 14, 1982

[54] PULLING TOOL

[76] Inventor: Gerald P. Wivinis, Vacation Village 18-4, Fox Lake, Ill. 60020

[21] Appl. No.: 232,232

[22] Filed: Feb. 6, 1981

[51] Int. Cl.[3] ..... B21D 1/12

[52] U.S. Cl. ..... 72/479; 72/705

[58] Field of Search ..... 72/457, 458, 478, 479, 72/705

[56] References Cited

U.S. PATENT DOCUMENTS

| | | | |
|---|---|---|---|
| 2,900,853 | 8/1959 | Steck | 72/457 |
| 3,100,336 | 8/1963 | Fannin | 72/479 |
| 3,545,250 | 12/1970 | Jones | 72/705 |
| 3,641,805 | 2/1972 | Reinke | 72/705 |
| 4,040,287 | 8/1977 | Wivinis | 72/705 |

FOREIGN PATENT DOCUMENTS

| | | | |
|---|---|---|---|
| 58985 | 9/1891 | Fed. Rep. of Germany | 72/458 |

*Primary Examiner*—Lowell A. Larson

[57] ABSTRACT

A pulling tool including a first pulling member which is essentially a rectangular-shaped flat bar of heavy metal having a pair of holes formed in it in spaced apart relationship. Affixed to one face of this flat bar is a pulling bar which likewise is a heavy metal material and which has a hole in it whereby a hydraulic jack or the like can be attached to the first pulling member. The pulling tool also includes a second generally U-shaped pulling member having a straight portion and a pair of legs which are spaced apart a distance corresponding to the distance between the two holes in the flat bar of the first pulling member, and a handle. In accordance with one embodiment of the invention, both of the pair of legs are threaded to receive a threaded nut, with the first and second pulling members being affixed together by extending the two legs of the second pulling member through the two apertures in the first pulling member, and then threadedly affixing the nuts on the legs.

5 Claims, 4 Drawing Figures

PULLING TOOL

BACKGROUND OF THE INVENTION

This invention relates to an improved pulling tool for use in body shops or the like for removing dents from the bodies of vehicles such as automobiles and trucks.

More particularly, in U.S. Pat. No. 4,040,287, there is disclosed a pulling tool which can be used to remove dents, without the need to remove, for example, a door panel to provide access to the back side of the door. In other words, the pulling tool can be attached to the dented area without the need to have access to the back side of the dented area to attach the pulling tool.

The pulling tool of the present invention is of the same type in that it can be attached to the dented area without the need to have access to the back side of the dented area to attach the pulling tool, but its construction is substantially different so as to provide various improvements to the pulling tool. The pulling tool furthermore can be used in various different applications.

Accordingly, it is an object of the present invention to provide an improved pulling tool for use with pulling dents from the bodies of vehicles such as automobiles and trucks.

BRIEF DESCRIPTION OF THE INVENTION

Generally, the pulling tool of the present invention includes a first pulling member which is essentially a rectangular-shaped flat bar of heavy metal having a pair of holes formed in it in spaced apart relationship. Affixed to one face of this flat bar is a pulling bar which likewise is of a heavy metal material and which has a hole in it whereby a hydraulic jack or the like can be attached to the first pulling member.

The pulling tool also includes a second generally U-shaped pulling member having a straight portion and a pair of legs which are spaced apart a distance corresponding to the distance between the two holes in the flat bar of the first pulling member, and a handle. In accordance with one embodiment of the invention, both of the pair of legs are threaded to receive a threaded nut, with the first and second pulling members being affixed together by extending the two legs of the second pulling member through the two apertures in the first pulling member, and then threadedly affixing the nuts on the legs. In accordance with the second embodiment, only one of the two legs is threaded to receive a threaded nut. The first and second pulling members are secured together by extending the first pulling member through the two apertures in the second pulling member and then threadedly securing the nut to the one leg. The handle on the second pulling member functions to retain or affix the first pulling member to the other leg.

The pulling tool is affixed to a dented area of a surface by first drilling two holes in the dented area using the first pulling member as a template. The second pulling member, in one case, is extended through one of the two holes and behind the dented area, and then out through the second hole. The first pulling member is affixed to the second pulling member by extending the latter's two legs through the two holes of the first pulling member and threadedly securing the two nuts on the legs. In the other case, the second pulling member first is extended through one of the two holes in the first pulling member and then through one hole in the dented area and out the other so that its flat portion is behind the dented area. The threaded leg then is extended through the other hole in the first pulling member and the threaded nut affixed to it.

BRIEF DESCRIPTION OF THE DRAWINGS

The above and other objectives and features of the invention will become apparent from the following description and accompanying drawing wherein.

DETAILED DESCRIPTION OF THE EMBODIMENT

Figure 1:
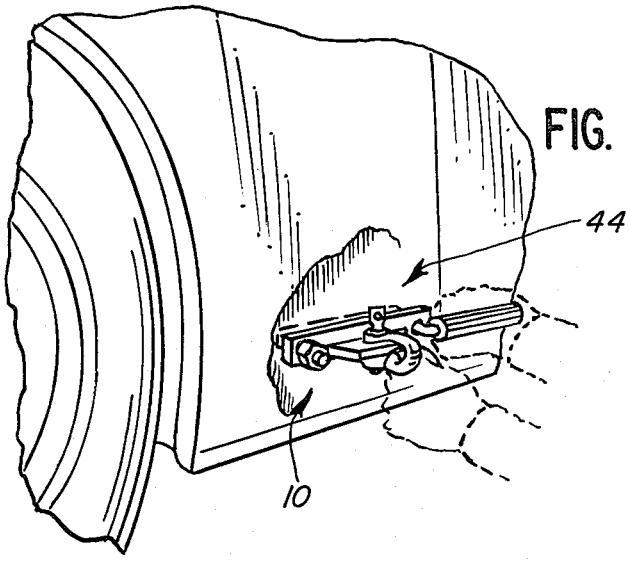
FIG. 1 is a partial perspective view generally illustrating the manner in which the pulling tool is attached to a vehicle body.

Referring now to the drawing, there is generally illustrated a pulling tool 10 which is of a two-piece construction including a first pulling member 12 and a second pulling member 24. The first pulling member 12, as can be best seen in FIG. 2, includes a flat bar 14 having two spaced apart holes 16 and 18 formed in it. The holes 16 and 18 preferably and advantageously are countersunk to function as guides, as more particularly described below. A pull bar 20 is fixedly secured to the one face of the flat bar 14 so as to extend perpendicular from it. The pull bar 20 has a hole 22 centrally formed in it which allows a hydraulic jack or the like to be affixed to the pulling tool 10 to assist in pulling the dent from the vehicle body. The flat bar 14 and the pull bar 20 both are of a heavy gauge metal material.

Figure 3:
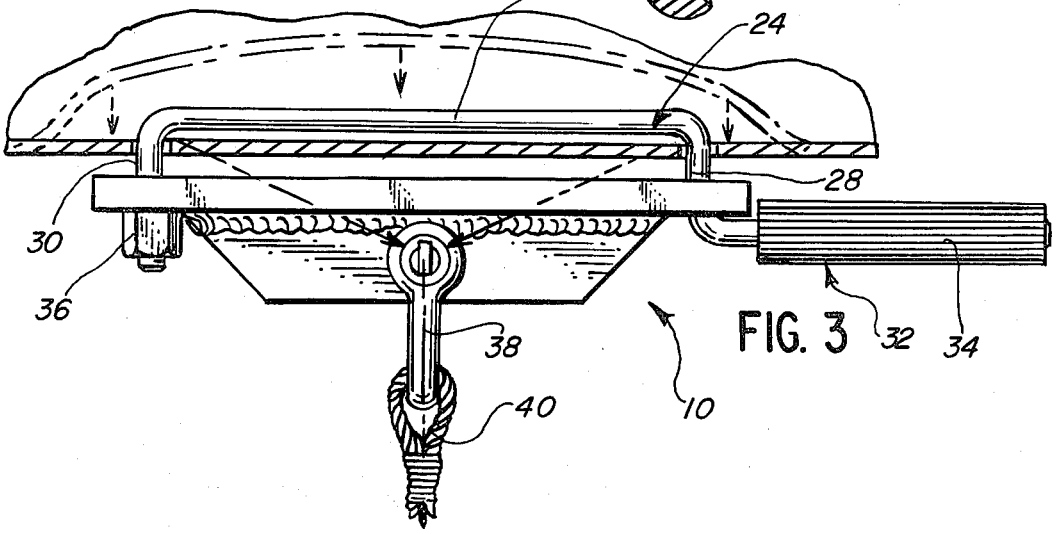
FIG. 3 is a top plan view, partially sectionalized, illustrating the manner in which the first and second pulling members are affixed together in association with the vehicle body to pull the dent from the vehicle body.

The second pulling member, as can be best seen in FIG. 3, in accordance with one embodiment, is of a generally U-shaped construction having a flat portion 26 and two parallel legs 28 and 30 which are spaced apart a distance corresponding to the distance between the two holes 16 and 18 in the first pulling member 12. The leg 28 terminates with a handle 32 which extends substantially parallel to the flat portion 26, and may have a rubber grip 34 or the like affixed to it. The leg 30 is threaded to receive a threaded nut 36.

Figure 2:
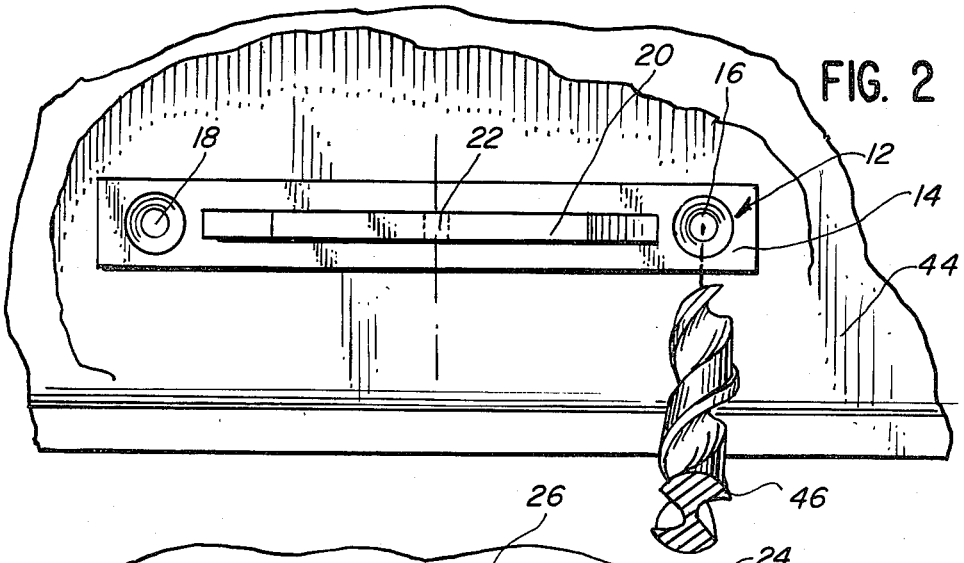
FIG. 2 is a partial side plan view generally illustrating the manner in which the first pulling member is used as a template to drill two holes in the dented area of the vehicle body.

The pulling tool 10 is affixed to the dented area of the vehicle body such as the vehicle 44 by first using the first pulling member 12 as a template to drill two holes in the vehicle body 44 in spaced apart relationship. This is accomplished simply by placing the first pulling member 12 against the dented area of the vehicle body 44, as illustrated in FIG. 2, and extending a drill 46 through the respective ones of the apertures 16 and 18. After the two holes have been drilled in the dented area of the vehicle body 44, the second pulling member is extended through one of the two holes in the first pulling member 12 and through the two holes drilled in the vehicle body 44, with the flat portion 26 thereof disposed behind the dented area of the vehicle body 44 and with the leg 30 extending through the one hole in the vehicle body to the front side thereof. The first and and second pulling members then are fixedly secured together by threadedly affixing the nut 36 on the threaded leg 30 of the second pulling member 24.

A U-shaped clamp 38 or the like having a cable 40 which extends to a hydraulic jack or the like now can be affixed to the pull bar 20 of the pulling tool 10 to assist in applying pressure to pull the dent from the vehicle body 44. Depending of course on the dented area to be repaired, in some cases, the dent can be pulled from the vehicle body by simply gripping the handle 32 and the U-shaped clamp 38, as illustrated in FIG. 1.

Figure 4:
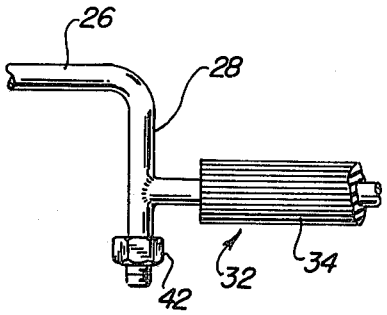
FIG. 4 is a partial top plan view illustrating the construction of the second pulling member, in accordance with a second embodiment of the invention.

As indicated above, in accordance with the second embodiment of the invention, the leg 28 of the second pulling member 24 can be extended and threaded to receive a threaded nut 42, as illustrated in FIG. 4. In this case, the function and operation of the pulling tool 10 is the same as described above, however, in this case, the second pulling member is simply threaded through the two holes formed in the dented area of the vehicle body 44, so that the flat portion of it is disposed behind the dented area, as illustrated in FIG. 3. The first pulling member 12 is then simply affixed to the second pulling member by extending the two legs 28 and 30 through the two holes 16 and 18 in the first pulling member 12 and then securing the threaded nuts 36 and 42 onto the threaded portions of these legs.

It will thus be seen that the objects set forth above, among those made apparent from the preceding description, are efficiently attained and certain changes may be made in the above article. Accordingly, it is intended that all matter contained in the above description, or shown in the accompanying drawings, shall be interpreted as illustrative and not in a limiting sense.

Now that the invention has been described, what it claimed as new and desired to be secured by Letters Patent is:

1. A pulling tool comprising, in combination, a first pulling member comprising a generally rectangular-shaped flat bar having a front side and a back side, a pair of apertures formed in said bar extending from the front side to the back side thereof, and a pull bar having an aperture therein fixedly secured to and extending outward perpendicular to one of said front and back sides of said flat bars, said first pulling member with said pair of apertures in said flat bar forming a template for drilling holes in a surface to be repaired; a second generally U-shaped pulling member having a straight portion and a pair of legs which are spaced-apart a distance corresponding to the distance between said pair of apertures in said flat bar, at least one of said pair of legs being threaded to receive a lock nut and the other one of said pair of legs having a handle integrally formed with and extending perpendicular thereto; and at least one lock nut; said pulling tool being affixed to a surface to be repaired by drilling two apertures in said surface using said first pulling member as a template, extending said pair of legs of said second pulling element through said two apertures in said first pulling element and through said two apertures in said surface with said straight portion disposed behind said surface to be repaired and with the two legs thereof projecting to the front of said surface and through the apertures in said first pulling member, said first and second pulling members being affixed together by said lock nut being threadedly affixed to said one leg.

2. The pulling tool of claim 1, wherein both of said pair of legs of said second generally U-shaped member are threaded to receive a lock nut, said pair of legs being extended through said pair of apertures in said first pulling member, and a pair of lock nuts for affixing said first and second pulling members together.

3. The pulling tool of claim 1, wherein said pair of apertures in said flat bar are countersunk to provide guides for a drill.

4. The pulling tool of claim 1, further comprising a U-clamp extendable through said aperture in said pull bar and providing means for attachment of hydraulic means or the like to said pulling tool.

5. The pulling tool of claim 1, further comprising resilient grip means on said handle.

* * * * *